United States Patent [19]

Nonaka et al.

[11] Patent Number: 4,944,237

[45] Date of Patent: Jul. 31, 1990

[54] DETECTING DEVICE OF THE FEEDING QUANTITY IN A SEWING MACHINE

[75] Inventors: Shiro Nonaka, Kariya; Seiichiro Hagino, Chiryu; Tsukasa Ando, Aichi, all of Japan

[73] Assignee: Aisin Seiki Kabushiki Kaisha, Kariya, Japan

[21] Appl. No.: 331,168

[22] Filed: Mar. 31, 1989

[30] Foreign Application Priority Data

Mar. 31, 1988 [JP] Japan ..... 63-80922

[51] Int. Cl.[5] ..... D05B 27/22; D05B 35/12

[52] U.S. Cl. ..... 112/315; 112/444

[58] Field of Search ..... 112/315, 314, 303, 445, 112/456, 458, 316, 317, 318, 319, 121.11, 444, 313

[56] References Cited

U.S. PATENT DOCUMENTS

| | | | |
|---|---|---|---|
| 4,242,974 | 1/1981 | Beckerman | 112/458 |
| 4,261,271 | 4/1981 | Makabe et al. | 112/458 |
| 4,644,887 | 2/1987 | Pech | 112/315 |
| 4,651,663 | 3/1987 | Murakami et al. | 112/458 |
| 4,706,584 | 11/1987 | Senda et al. | 112/315 X |
| 4,794,875 | 1/1989 | Noguchi et al. | 112/315 |
| 4,817,542 | 4/1989 | Ando et al. | 112/315 X |

*Primary Examiner*—Peter Nerbun

*Attorney, Agent, or Firm*—Oblon, Spivak, McClelland, Maier & Neustadt

[57] ABSTRACT

A detecting device of the feeding quantity of material in a sewing machine includes a dial rotatably mounted on an arm of the sewing machine, a mechanism operatively connected to the dial for varying the feeding quantity in response to the rotational quantity of the dial, a signal generator converting the rotational quantity into the electric signals, and a display device electrically connected to the signal generator for displaying signals outputted therefrom.

3 Claims, 1 Drawing Sheet

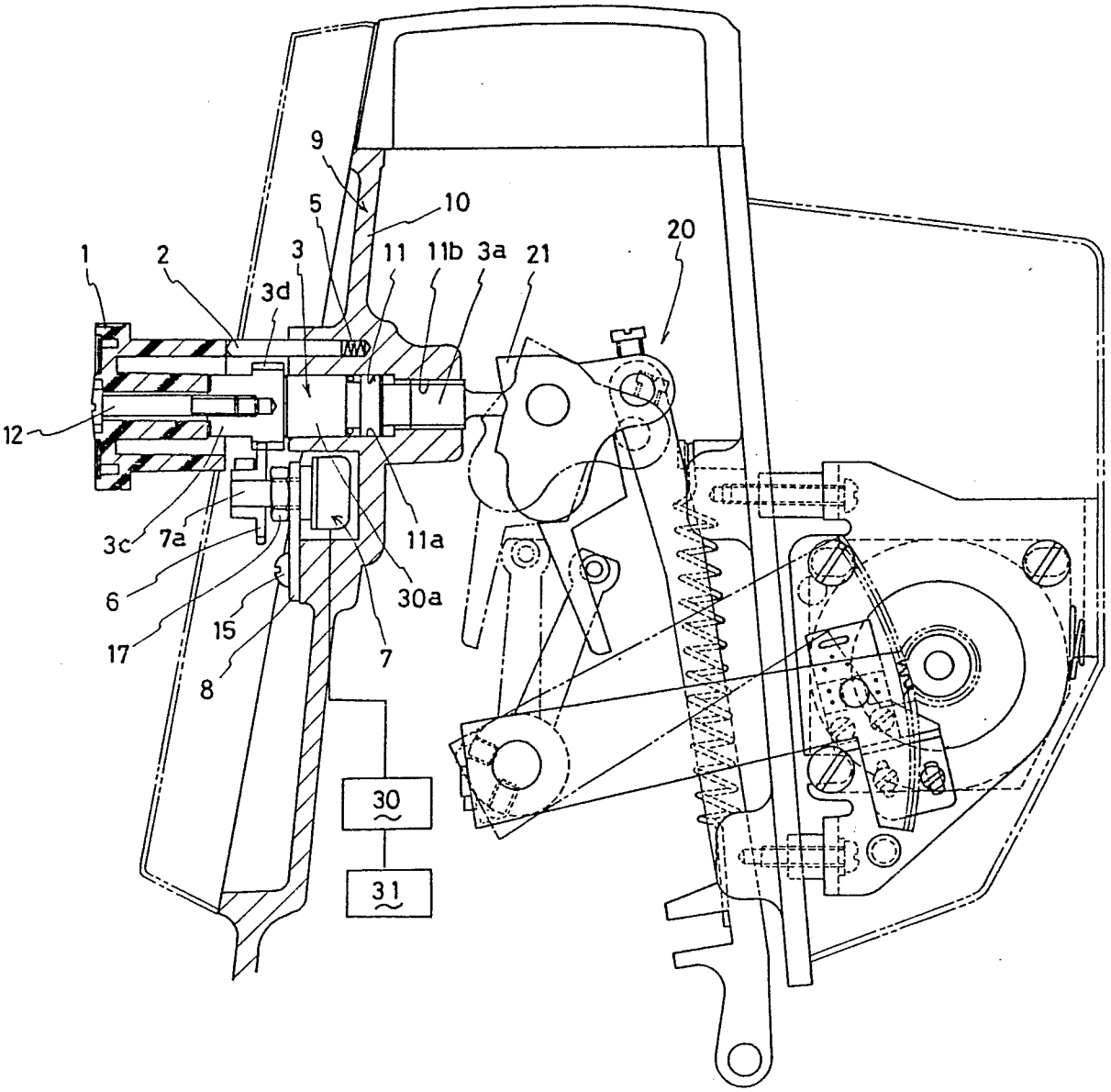
20
21
3a
11b
10
11
9
5
3
3d
2
1
12
11a
30a
7
7a
3c
6
17
15
8
30
31

DETECTING DEVICE OF THE FEEDING QUANTITY IN A SEWING MACHINE

BACKGROUND OF THE INVENTION

1. Field of the Invention

The present invention relates to a detecting device of the feeding quantity which is used in a sewing machine.

2. Description of the related art

In a conventional detecting device of the feeding quantity as disclosed in Japanese Utility Model Laid-open Publication No. 59-178970, a material to be detected is provided to a horizontally-feeding shaft and the feeding quantity of the material is sensed by measuring the time that a sensor senses the material.

However, since the horizontally-feeding shaft is operatively connected to a main shaft, the sewing machine has to be driven in order to detect the feeding quantity.

SUMMARY OF THE INVENTION

It is, therefore, a principal object of the present invention to provide a detecting device of the feeding quantity of material in a sewing machine without the aforementioned drawback.

Another object of the present invention is to provide a detecting device of the feeding quantity of material in a sewing machine by which the feeding quantity can be detected without driving the sewing machine.

According to the present invention, a detecting device of the feeding quantity is comprised of a normally stationary dial rotatably mounted on an arm of a sewing machine, mechanical means operatively connected to the dial for varying the feeding quantity in response to the rotational quantity of the dial, a signal generator means for converting the rotational quantity of the dial into electric signals, and display means electrically connected to the signal generator means for displaying signals outputted therefrom.

The means for varying the feed quantity comprises an adjusting member fixed to the dial and threaded into the arm. A portion of the adjusting member engages a feeding quantity adjusting mechanism of the sewing machine. The signal generator includes a microprocessor independent of the means for varying the feeding quantity, and a variable resistor having an output connected to the microprocessor and having a shaft rotated by the rotation of the dial.

BRIEF DESCRIPTION OF THE DRAWING

The above and other objects, features and advantages of the present invention will become apparent and more readily appreciated from the following detailed description of preferred exemplary embodiment of the invention, taken in connection with the accompanying drawing, in which:

The single figure is a cross-sectional view of a detecting device of the feeding quantity according to one embodiment of the present invention.

DETAILED DESCRIPTION OF THE PREFERRED EMBODIMENT

Referring now to the single figure, a hole 11 is formed in a front panel 10 of an arm 9 of a sewing machine such as that shown in Japanese Utility model publication No. 59-178970. The hole 11 is formed into a stepped configuration and has a large-diameter portion 11*a* which is located towards the end of the hole 11 at the outside of the arm 9 and a small-diameter portion 11*b* which is located at the end of the hole 11 at the inside of the arm 9. An inner periphery of the small-diameter portion 11*b* is threaded. A large diameter section 3*a* and a small-diameter section 3*b* of an adjusting member 3 are rotatably supported, respectively, in the large-diameter portion 11*a* and the small-diameter portion 11*b* of the hole 11. A connecting section 3*c* of the adjusting member which is located outside of the hole 11 is operatively connected to a dial 1 via a screw 12 threaded into the adjusting member. Upon rotation of the dial 1, the dial, the connecting section 3*c*, the large-diameter section 3*a* and a small-diameter section 3*b* of the adjusting member 3 are rotated as one unit.

Since the small-diameter section 3*b* of the adjusting member 3 is threaded in the hole 11, upon rotation of the adjusting member the small-diameter section 3*b* is moved axially relative to the small-diameter portion 11*b* of the hole 11. The distal end of the small-diameter section 3*b* is in abutment with a cam 21 of a mechanism 20 for varying the feeding quantity, which is of well-known construction. The feeding quantity is thus determined based on the quantity of axial movement of the distal end of the small-diameter section 3*b* of the adjusting member 3.

A splined portion 3*d* is formed on the connecting section 3*c* of the adjusting member 3 and is in mesh engagement with a gear 6 which is fixedly mounted on a shaft 7*a* of a variable resistor 7. Thus, the shaft 7*a* of the variable resistor 7 rotates as the dial 1 rotates. The resistor 7 is secured to a plate 8 by means of a nut 17. The plate 8 is secured to the front panel 10 by a screw 15.

The variable resistor 7 is electrically connected to a signal generator 30 in the form of a microprocessor. The signal generator 30 generates signals which vary in response to the variation of the resistor 7 corresponding to the rotational quantity of the dial 1. The signals are digitally displayed at a display device 31. Thus, an operator for a sewing machine can read the feeding quantity as a digital read-out while adjusting the dial 1.

It is noted that elastic force is applied to the dial 1 from a spring 5 fitted in the arm via a shaft 2 for giving a secure feeling to the operator.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A detecting device of the feeding quantity of material in a sewing machine, comprising:

a normally stationary dial rotatably mounted on an arm of the sewing machine;

mechanical means operatively connected to the dial for varying the feeding quantity in response to the rotational quantity of the dial, wherein said means for varying the feeding quantity comprises an adjusting member fixed to said dial and threaded into said arm, and wherein a portion of said adjusting member engages a feeding quantity adjusting mechanism of the sewing machine;

signal generator means for converting the rotational quantity of the dial into electric signals, wherein the signal generator means includes a microprocessor independent of said means for varying the feeding quantity, and a variable resistor having an output connected to the micro-processor and having a shaft rotated by the rotation of said dial; and display means electrically connected to the signal generator means for displaying signals outputted therefrom.

2. A detecting device of the feeding quantity according to claim 1, wherein the display means is a digital display device.

3. A detecting device of the feeding quantity according to claim 1, further comprising spring means for applying pressure to the dial.

* * * * *